US008562845B2

(12) United States Patent
Hayakawa

(10) Patent No.: US 8,562,845 B2
(45) Date of Patent: Oct. 22, 2013

(54) INK JET PRINT HEAD AND METHOD OF MANUFACTURING INK JET PRINT HEAD

(75) Inventor: Kazuhiro Hayakawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1516 days.

(21) Appl. No.: 11/868,113

(22) Filed: Oct. 5, 2007

(65) Prior Publication Data

US 2008/0088674 A1 Apr. 17, 2008

(30) Foreign Application Priority Data

Oct. 12, 2006 (JP) ..... 2006-278785
Oct. 12, 2006 (JP) ..... 2006-278786

(51) Int. Cl.
*B41J 2/14* (2006.01)
*B44C 1/22* (2006.01)

(52) U.S. Cl.
USPC ..... 216/27; 216/41; 216/58; 216/83; 29/890.1

(58) Field of Classification Search
USPC ..... 216/27, 41, 58, 83; 29/890.1
See application file for complete search history.

(56) References Cited

U.S. PATENT DOCUMENTS

| | | | | |
|---|---|---|---|---|
| 6,019,457 | A | 2/2000 | Silverbrook | |
| 6,143,190 | A | 11/2000 | Yagi et al. | |
| 6,234,608 | B1 * | 5/2001 | Genovese et al. | 347/54 |
| 6,264,849 | B1 * | 7/2001 | Silverbrook | 216/27 |
| 6,303,042 | B1 | 10/2001 | Hawkins et al. | |
| 6,979,076 | B2 | 12/2005 | Baek et al. | |
| 7,063,799 | B2 | 6/2006 | Hayakawa et al. | |
| 7,323,115 | B2 | 1/2008 | Hayakawa et al. | |
| 2002/0075360 | A1 | 6/2002 | Maeng et al. | |
| 2003/0058309 | A1 | 3/2003 | Haluzak et al. | |
| 2004/0174407 | A1 * | 9/2004 | Hayakawa et al. | 347/20 |
| 2006/0044347 | A1 * | 3/2006 | Kwon et al. | 347/44 |
| 2006/0146102 | A1 | 7/2006 | Kim et al. | |
| 2006/0256162 | A1 | 11/2006 | Hayakawa | |
| 2007/0058001 | A1 | 3/2007 | Hayakawa | |

FOREIGN PATENT DOCUMENTS

| | | |
|---|---|---|
| CN | 1631672 | 6/2005 |
| JP | 2004-066537 | 3/2004 |
| JP | 2004-351931 | 12/2004 |
| TW | 200503900 | 2/2005 |
| TW | 200621515 | 7/2006 |

OTHER PUBLICATIONS

English translation of TW 2006-21515.
English translation of TW 2005-03900.

* cited by examiner

*Primary Examiner* — Shamim Ahmed
(74) *Attorney, Agent, or Firm* — Fitzpatrick, Cella, Harper & Scinto

(57) ABSTRACT

The present invention provides an ink jet print head having a channel shape that meets an intended purpose, and a method for manufacturing the ink jet print head. In the method for manufacturing the ink jet print head, an SIO SOI substrate is prepared which has a first silicon layer, a second silicon layer, and an insulating layer. A sacrifice layer is formed on the first monocrystal silicon layer. An etching stop layer is formed over the sacrifice layer. An energy generating element is formed on a surface of the SOI substrate. Etching is performed on the second silicon layer and the insulating layer to form an ink supply port. The supply port is formed by etching. The first silicon layer is etched to form a liquid channel. A part of the etching stop layer is removed to form an ejection port.

5 Claims, 11 Drawing Sheets

INK JET PRINT HEAD AND METHOD OF MANUFACTURING INK JET PRINT HEAD

BACKGROUND OF THE INVENTION

1. Field of the Invention

The present invention relates to an ink jet print head and a method for manufacturing an ink jet print head.

2. Description of the Related Art

An ink jet print head used for an ink jet printing method (liquid ejection printing method) commonly comprises a plurality of fine ejection ports and a plurality of fine liquid channels formed in an orifice plate, and a plurality of liquid ejection pressure generating sections each provided in a part of the corresponding liquid channels. The ink jet print head often further comprises a supply port formed in a head substrate in communication with the liquid channels and serving as a through-hole.

Such an ink jet print head has heat generating sections (heaters) in the respective channels, which are in communication with the corresponding ejection ports; each corresponding heat generating section, channel, and ejection port constitute a print element. Electric energy corresponding to a print signal is selectively applied to a heating resistor in the appropriate heater. The resulting energy is utilized to rapidly heat ink on a heat acting surface. This results in film boiling to generate bubbles, so that the pressure of the bubbles causes the ink to be ejected from the corresponding ejection port.

As a print head having the heaters as described above, for example, U.S. Pat. No. 6,019,457 discloses an ink jet print head of back chute type (hereinafter called print head of back chute type) comprising a liquid ejection pressure generating section on a liquid channel surface of an orifice plate. For the print head of back chute type, a general-purpose semiconductor manufacture method can be used to continuously form an orifice plate or a part thereof, and a liquid ejection pressure generating section and a driving circuit both arranged on a substrate surface.

The substrate of the print head of back chute type is manufactured by, for example, a silicon on insulator (SOI) technique. The substrate formed of a monocrystal silicon semiconductor layer on an insulator by the SOI technique provides the substrate with various advantages compared with a bulk silicon substrate on which an ordinary silicon integrated circuit is manufactured. The print head of back chute type having this SOI substrate is disclosed in U.S. Pat. No. 6,979,076.

A method for manufacturing a print head of back chute type is as described below.

B1. Step of preparing an SOI substrate 901 having an insulating layer 903 therein, B2. Step of forming grooves reaching the insulating layer 903, in a front surface of the substrate with respect to the insulating layer 903, in alignment with positions where a wall of the liquid channel is to be formed, B3. Step of forming a first etching stop layer 920 on the front surface of the substrate and on a surface of the groove (FIG. 8A), B4. Step of forming an energy generating element 906 and a driving circuit therefor on the first etching stop layer 920 on the substrate surface, B5. Step of forming a supply port 908 extending from a back surface of the SOI substrate with respect to the insulating layer 903, to the insulating layer 903, B6. Step of forming a second etching stop layer 921 on an inner surface of the supply port 908, B7. Step of selectively removing a part of the etching stop layer 921 which is in contact with the insulating layer 903 (FIG. 8B), B8. Step of removing a part of the insulating layer 903 which is exposed in the supply port 908, B9. Step of removing a part surrounded by the insulating layer 903 and first etching stop layer 920 in the substrate, via the supply port 908 by an isotropic etching technique, and B10. Step of etching the first etching stop layer 920 to form an ejection port 910 (FIG. 8C).

In the ink jet print head manufactured by the steps B1 to B10, the part surrounded by the first etching stop layer 920 and the insulating layer 903 is removed by the etching technique to form a channel 909.

Further, the ink jet print head manufactured by the above manufacturing method must form the first etching stop layer 920 in areas that are formed into walls of the liquid channel. This generally requires a photolithography step, an etching step based on RIE and a film formation step executed on inner walls. This in turn complicates the entire process.

Moreover, in step B4, the energy generating element and the driving circuit therefor are formed. Thus, the grooves formed must be filled with the first etching stop layer 920 and the width of the grooves must be sufficiently small, for example, about 2 μm.

On the other hand, the dimension of the liquid channel perpendicular to the substrate surface, that is, the depth of the liquid channel, is preferably at least 10 μm. The grooves formed need to have a high aspect ratio. In this case, the groove formation requires a longer time, which may not result in high productivity.

SUMMARY OF THE INVENTION

The present invention has been made in view of the above problems. An object of the present invention is to provide an ink jet print head having a liquid channel shape that meets an intended purpose, and a method for manufacturing the ink jet print head.

Thus, the present invention provides a method for manufacturing an ink jet print head comprising an ink ejection port, an energy generating element that generates energy utilized to eject ink from the ejection port, an ink channel that is in communication with the ejection port, and an ink supply port that is in communication with the channel to supply ink, the method comprising: a step of preparing an SOI substrate having a first silicon layer, a second silicon layer, and an insulating layer provided between the first silicon layer and the second silicon layer; a step of using a material that can be selectively etched in contrast to silicon to form a sacrifice layer on the first silicon layer; a step of forming an etching stop layer over the sacrifice layer; a step of forming an energy generating element on a surface of the SOI substrate; a step of performing removing a part of the second silicon layer and the insulating layer to form the ink supply port; a step of performing etching on the first silicon layer to form the channel; and a step of removing a part of the etching stop layer to form the ejection port.

The ink jet print head in accordance with the present invention enables the liquid channel to be formed along the insulating layer. This enables accurate manufacturing of the communication portion between the supply port and the liquid channel, enabling a stable substrate to be provided. Furthermore, the ink jet print head which has the liquid channel shape meeting the intended purpose can be obtained.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

First Embodiment

Figure 1:
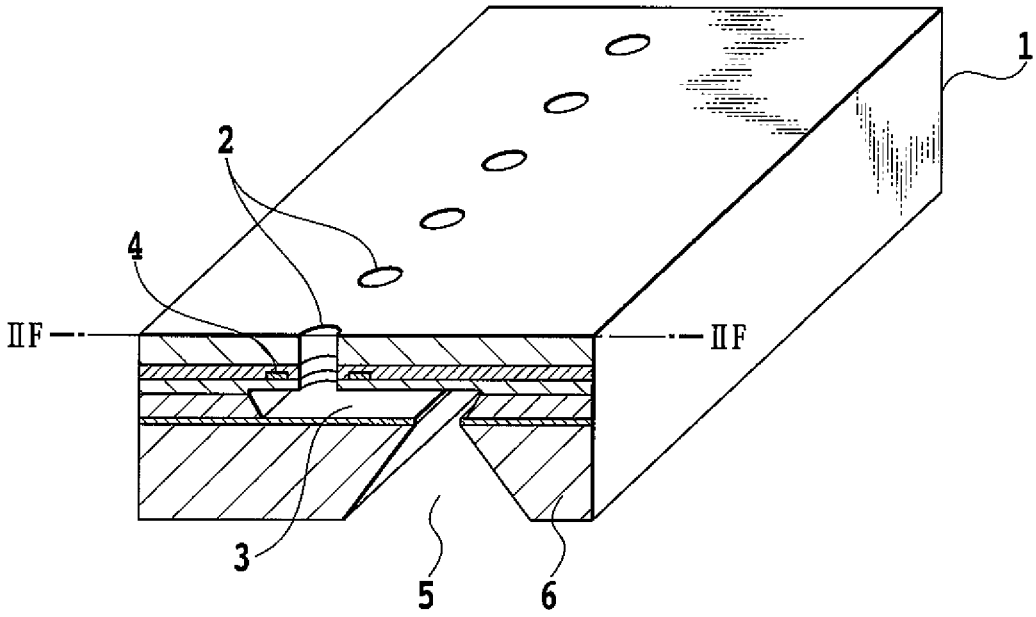
FIG. 1 is a diagram showing an ink jet print head in accordance with a first embodiment of the present invention.

FIG. 1 is a partly exploded perspective view showing an ink jet print head in accordance with the present embodiment. An ink jet print head 1 has a plurality of ejection ports 2, a liquid channel 3, a plurality of heaters 4, and an ink supply port 5 which are all formed on a silicon substrate 6. Ink is fed from the ink supply port 5 to the liquid channel 3 and ejected from the ejection ports 2 by the thermal energy of the heaters 4 provided in the respective liquid channel 3 and serving as energy generating elements. The energy generating elements 4 are not limited to the heaters but may be piezoelectric elements or the like. In the present embodiment, each of the ejection ports 2 is provided in a corresponding area surrounded by or sandwiched between the energy generating elements 4. However, the present invention is not limited to this. Each ejection port may be located adjacent to one side of the corresponding energy generating element 4.

The ink jet print head can be mounted in apparatuses such as printers, copiers, facsimile machines having a communication system, and word processors having a printer section, as well as industrial printing apparatus compositely combined with processing apparatuses. This liquid ejection head enables printing of various print media such as paper, yarns, fibers, clothes, leathers, metal, plastics, glass, woods, and ceramics. The term "printing" as used herein means the application of not only meaningful images such as characters or graphics but also meaningless images such as patterns to the print media.

The term "ink" or "liquid" should be broadly interpreted and refers to a liquid applied to the print media to form images, patterns, or the like, to process the print media, or to treat the ink or the print media. Here, the treatment of the ink or the print media means, for example, the improvement of fixability by solidification or insolubilization of color materials in ink applied to the print media, the improvement of printing grade or coloring property, or the improvement of image durability.

FIGS. 2A to 2F are cross section views showing a method for manufacturing an ink jet print head in accordance with the first embodiment of the present invention, taken along line IIF-IIF in FIG. 1.

Figure 2A:
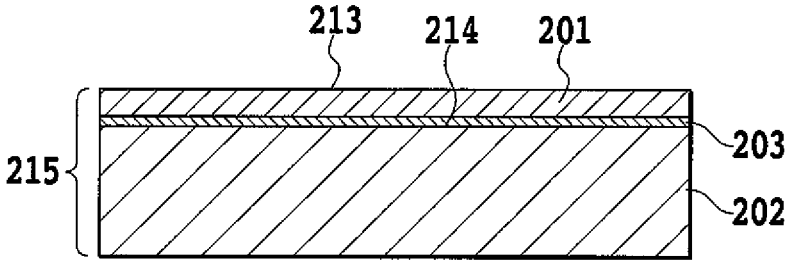
FIGS. 2A to 2F are diagrams showing a process of manufacturing an ink jet print head in accordance with the first embodiment of the present invention.

First, as shown in FIG. 2A, an SOI substrate 215 of diameter 150 mm is prepared which has a first monocrystal silicon layer 201, an insulating layer 203, and a second monocrystal silicon layer 202. In the present embodiment, the first monocrystal silicon layer 201 has a main surface 213 of a {100} plane and a thickness of 25 μm. The insulating layer 203 is a silicon oxide layer of thickness 0.3 μm. The second monocrystal silicon layer 202 has a main surface 214 of a {100} plane and a thickness of 600 μm.

FIG. 2A is a diagram showing an SOI substrate 215 formed of a first monocrystal silicon layer 201 made of monocrystal silicon having a main surface 213 of a {100} plane, an insulating layer 203, and a second monocrystal silicon layer 202 made of monocrystal silicon having main surface 214 of a {100} plane.

Then, an aluminum layer constituting a sacrifice layer 204 is patterned on a surface (hereinafter also referred to a front surface) on which the first monocrystal silicon layer 201 is present, in accordance with the shape of the liquid channel. The sacrifice layer 204 has a compensation pattern in a corner portion so as to allow etching described below to be appropriately performed. That is, when the compensation pattern is formed in the communication portion between a liquid channel forming portion and a supply port forming portion, the sacrifice layer can be shaped like a constricted plane, for example, in a portion in which the tip of a rib that is a wall partitioning the liquid channel is formed.

In the present embodiment, aluminum, which is dissoluble to alkali, is used for the sacrifice layer 204. However, porous silicon, any other crystal silicon, amorphous silicon, or the like may be used. In these cases, a single crystal anisotropic etching operation enables a step of etching the SOI substrate, described below, from the back surface thereof up to the sacrifice layer 204 and a step of removing the sacrifice layer 204 to form a liquid channel.

The sacrifice layer 204 may be made of a material that can be removed by fluorinated hydrogen such as silicon oxide. The insulating layer 203 may be made of an inorganic layer such as silicon nitride, silicon carbide, or alumina, or a material that is not easily removed by fluorinated hydrogen. In this case, fluorinated hydrogen can be used in the step of removing the sacrifice layer 204, described below.

Then, a silicon nitride layer serving as the etching stop layer 205 is formed on the sacrifice layer 204. Then, a general-purpose semiconductor step is executed to form a heating resistor 206 that is an energy generating element generating energy utilized to eject a liquid, and a driving circuit therefor. An additional film may be formed on the driving circuit by a coating technique such as plating to thicken the orifice plate. The thickened orifice plate enables an increase in the length of the ejection port and the rectilinearity of ejected ink.

A protective layer 212 of heating resistor 206 made by silicon nitride is formed on the uppermost layer. A silicon oxide layer 207 is formed on a surface (hereinafter also referred to as a back surface) on which the second monocrystal silicon layer 202 is present.

Figure 2B:
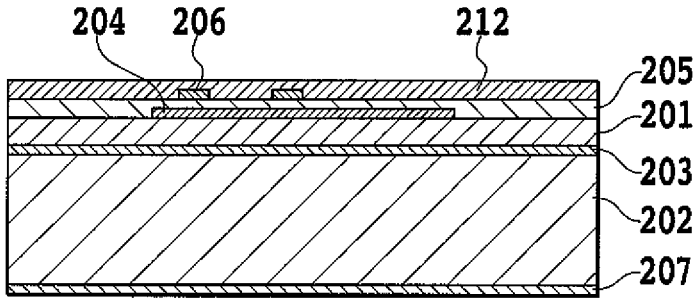

FIG. 2B shows the substrate on which the back surface mask layer 207, second monocrystal silicon layer 204, insulating layer 203, sacrifice layer 204, etching stop layer 205, heating resistor 206, and silicon nitride layer 207 have been stacked.

Gold as a heat release element may subsequently be grown into an additional layer by plating on the protective layer 212. In this case, the gold may be prevented from being present at an ejection port forming position by performing a dry film at the ejection port forming position by patterning, and after the plating growth, removing the dry film.

Then, a cyclized rubber resin is applied to the front surface of the substrate to form a temporary protective film 211. An area on the back surface in which a supply port for a silicon oxide layer is to be formed is etched away. The second monocrystal silicon layer 202 is subjected to crystal anisotropic etching and etched up to the insulating layer 203. A supply port 208 is formed by removing part of the second monocrystal silicon layer 202 and part of the insulating layer 203.

Figure 2C:
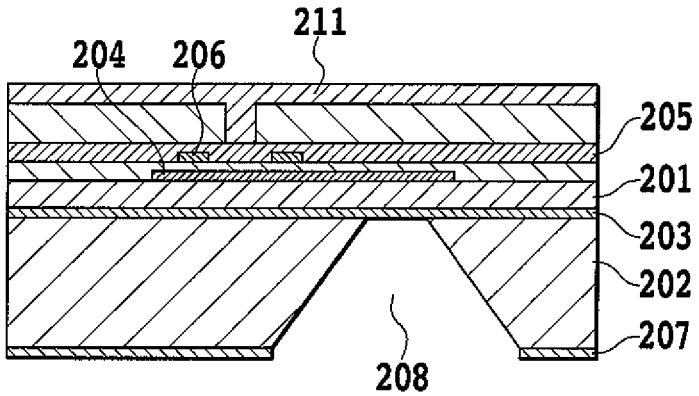

FIG. 2C is a diagram showing the substrate in which the supply port 208 has been formed up to the insulating layer 203.

Then, the insulating layer 203 is removed via the supply port, and the first monocrystal silicon layer 201 is subjected to crystal anisotropic etching in such a manner that the etching progresses to the aluminum layer, the sacrifice layer 204.

Figure 2D:
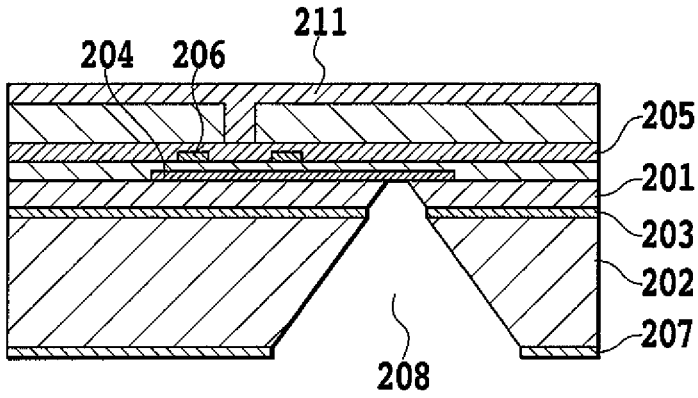

FIG. 2D is a diagram showing the substrate in which the etching has progressed to the sacrifice layer 204.

The etching is continued to remove the sacrifice layer 204, while forming a liquid channel along the pattern of the sacrifice layer 204.

Figure 2E:
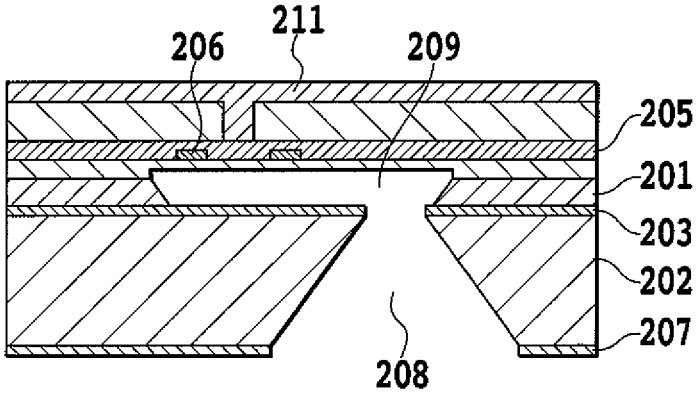

FIG. 2E is a diagram showing a substrate in which a liquid channel 209 having a bottom surface formed of the insulating layer 203 has been formed along the pattern of the sacrifice layer 204. In this case, the bottom surface of the liquid channel is formed of the insulating layer 203 or side surfaces of the liquid channel are formed of (111) faces.

Finally, cyclized rubber is removed using xylene, and the silicon nitride layer, the etching stop layer 205, is etched by RIE to form an ejection port.

Figure 2F:
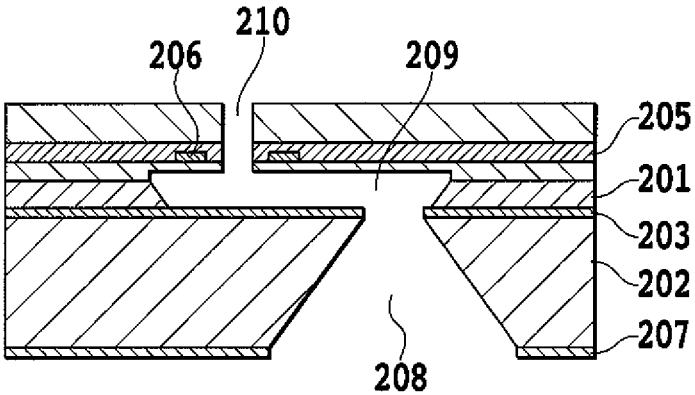

FIG. 2F is a diagram showing the substrate in which the ejection port 210 has been formed.

Second Embodiment

FIGS. 3A to 3F are cross section views showing a method for manufacturing an ink jet print head in accordance with a second embodiment of the present invention. The cross section is the same as FIGS. 2A to 2F. The present embodiment corresponds to an example in which two monocrystal silicon layers in an SOI substrate have different crystal directions.

First, an SOI substrate 314 of diameter 150 mm is prepared which is manufactured by laminating a first monocrystal silicon layer, an insulating layer, and a second monocrystal silicon layer. In the present embodiment, a first monocrystal silicon layer 301 has a main surface 312 of a {100} plane and a thickness of 25 μm. An insulating layer 303 is a silicon oxide layer of thickness 0.3 μm. A second monocrystal silicon layer 302 has a main surface 313 of a {110} plane and a thickness of 600 μm.

Figure 3A:
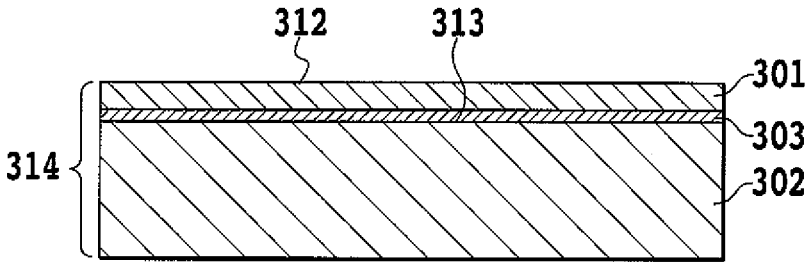
FIGS. 3A to 3F are diagrams showing a process of manufacturing an ink jet print head in accordance with a second embodiment of the present invention.

FIG. 3A is a diagram showing an SOI substrate 314 formed of the first monocrystal silicon layer 301 made of monocrystal silicon having the main surface 312 of a{100} plane, the insulating layer 303, and the second monocrystal silicon layer 302 made of monocrystal silicon having the main surface 313 of a {100} plane.

Then, an aluminum layer constituting a sacrifice layer 304 is patterned on a surface (hereinafter also referred to a front surface) on which the first monocrystal silicon layer 301 is present, in accordance with the shape of a liquid channel. The sacrifice layer 304 has a compensation pattern in a corner portion so as to allow etching described below to be appropriately performed. That is, when the compensation pattern is formed in the communication portion between a liquid channel forming portion and a supply port forming portion, the sacrifice layer can be shaped like a constricted plane, for example, in a portion in which the tip of a rib that is a wall partitioning the liquid channel is formed.

The material of the sacrifice layer is the same as that in the first embodiment.

Then, a silicon nitride layer serving as both an etching stop layer 305 and an insulating layer is formed on the sacrifice layer 304. Then, a general-purpose semiconductor step is executed to form a heating resistor 306 that is an energy generating element generating energy utilized to eject a liquid, and a driving circuit therefor. An additional film may be formed on the driving circuit by a coating technique such as plating to thicken the orifice plate. The thickened orifice plate enables an increase in the length of the ejection port and the rectilinearity of ejected ink.

A silicon nitride layer is formed on the uppermost layer. A silicon oxide layer 307 is formed on a surface (hereinafter also referred to as a back surface) on which the second monocrystal silicon layer 302 is present.

For the driving circuit, an MOS transistor may be provided on the first monocrystal silicon layer 301.

Figure 3B:
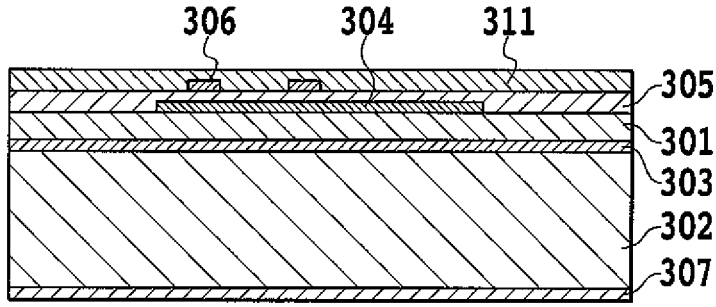

FIG. 3B shows the substrate on which the back surface mask layer 307, second monocrystal silicon layer 302, insulating layer 303, sacrifice layer 304, etching stop layer 305, heating resistor 306, and silicon nitride layer 307 have been stacked.

Gold may subsequently be grown into an additional layer by plating. In this case, the gold may be prevented from being present at an ejection port forming position by preforming a dry film at the ejection port forming position by patterning, and after the plating growth, removing the dry film.

Then, a cyclized rubber resin is applied to the front surface of the substrate to form a temporary protective film (not shown). An area on the back surface in which a supply port for a silicon oxide layer is to be formed is etched away. Then, a guide hole 311 extending downward to the vicinity of the insulating layer is formed in a corner portion of the pattern by laser. The guide hole serves as a channel for an anisotropic etchant during crystal anisotropic etching described below. The guide hole increases the etching rate and allows the etching to be started from an inner surface of the guide hole. The guide hole thus makes it possible to determine an etching start surface. The second monocrystal silicon layer 302 is subjected to crystal anisotropic etching in such a manner that the etching progresses to the insulating layer 303 to form a supply port.

Figure 3C:
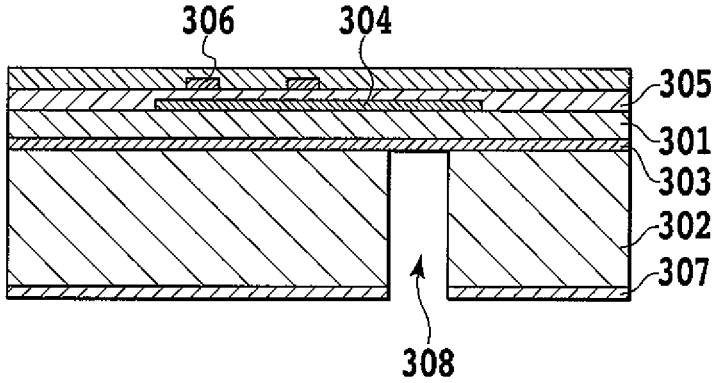

FIG. 3C is a diagram showing the substrate in which the supply port 308 has been formed.

Then, the insulating layer 303 is removed via the supply port 308, and the first monocrystal silicon layer 301 is subjected to crystal anisotropic etching in such a manner that the etching progresses to the aluminum layer, the sacrifice layer 304.

Figure 3D:
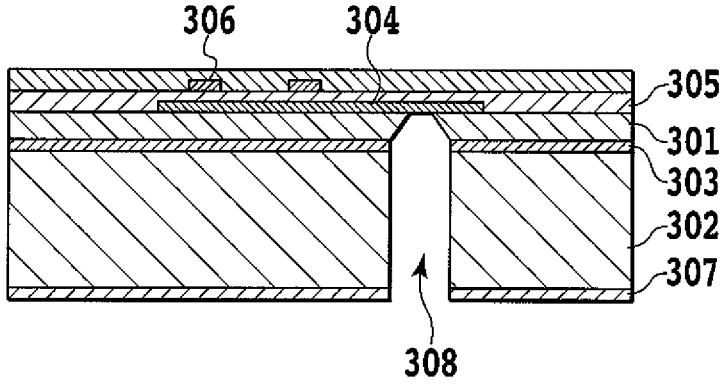

FIG. 3D is a diagram showing the substrate in which the etching has progressed to the sacrifice layer 304.

The etching is continued to remove the sacrifice layer 304, while forming a liquid channel along the pattern of the sacrifice layer 304. At this time, a bottom surface of the liquid channel is formed of an insulating layer.

Figure 3E:
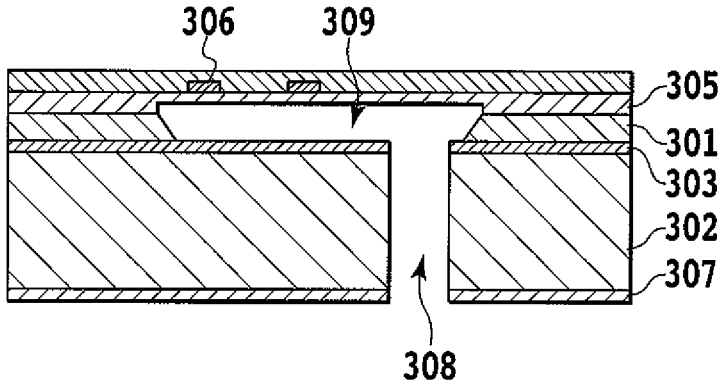

FIG. 3E is a diagram showing the substrate in which a liquid channel 309 has been formed along the pattern of the sacrifice layer 204.

Finally, cyclized rubber is removed using xylene, and the silicon nitride layer, the etching stop layer 305, is etched by RIE to form an ejection port.

Figure 3F:
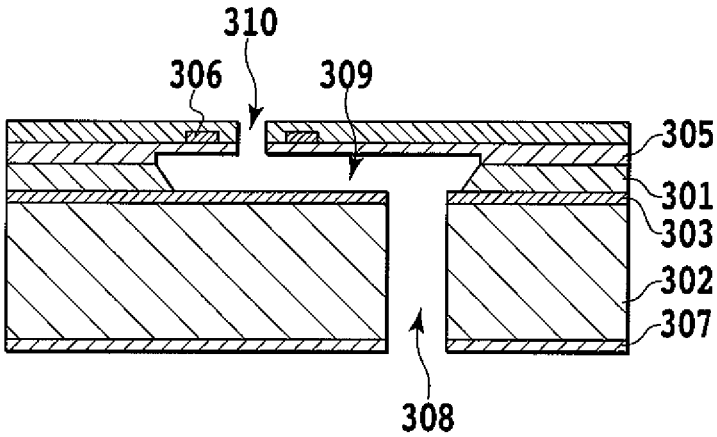

FIG. 3F is a diagram showing the substrate in which the ejection port 310 has been formed.

Figure 4A:
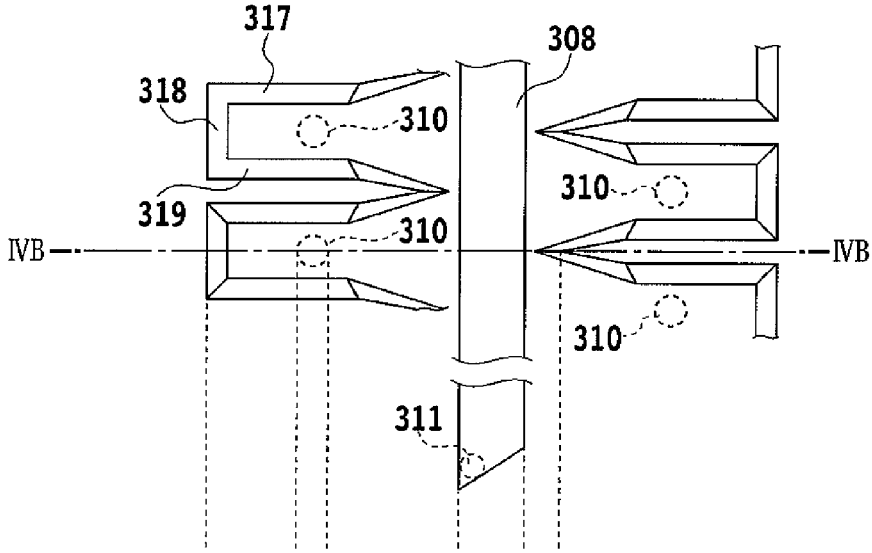
FIGS. 4A and 4B are diagrams showing an ink jet print head in accordance with the second embodiment of the present invention.
Figure 4B:
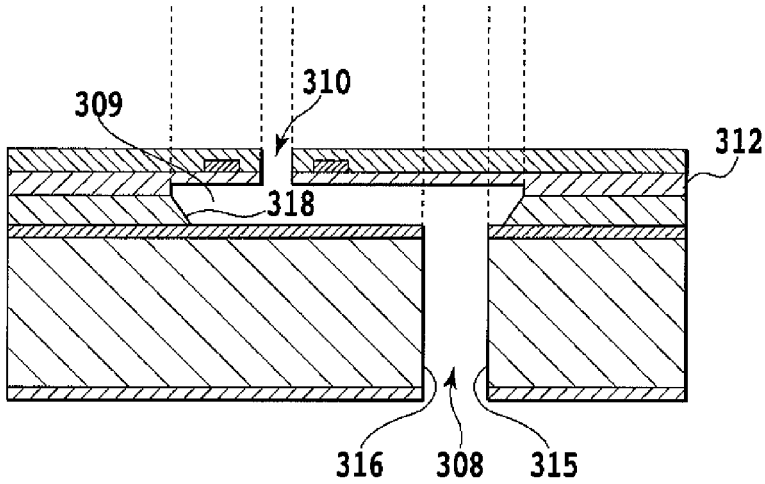

FIGS. 4A and 4B are a top view and a sectional view of the ink jet print head in accordance with the present embodiment described with reference to FIGS. 3A to 3F (same as FIGS. 2A to 2F); the sectional view is taken along dashed line IVB-IVB. Reference numeral 311 denotes a position where the guide hole formed in the second monocrystal silicon layer was present. The second monocrystal silicon layer 302 has a main surface 313 of a {100} plane. At least two side surfaces 315, 316 of the supply port 308 are substantially made of (111) faces perpendicular to the substrate. This enables a number of supply ports 308 to be densely arranged. This in turn enables a reduction in the size of the print head. If a plurality of print heads are to be obtained from a single silicon wafer, more print heads can be obtained. Consequently, productivity can be improved. Further, as shown in the top view in FIG. 4A (ejection port forming surface), the end of the groove of the supply port 308 is a position where the guide hole 311 was previously formed before etching. That is, the shape of by etching can be defined by forming guide hole 311 before etching.

The first monocrystal silicon layer 301 has the main surface 312 of a {100} plane. The liquid channel 309 has at least three side surfaces (ex. 317, 318, 319) made substantially of (111) faces.

If the driving circuit comprises a MOS transistor in the first monocrystal silicon layer 301, the MOS transistor provided on the monocrystal silicon with the main surface of a {100} plane can have a reduced surface area due to electron mobility. This further enables a reduction in the size of the print head.

The present embodiment uses the first monocrystal silicon layer 301 with the main surface 312 of a {100} plane and the second monocrystal silicon layer 302 with the main surface 313 of a {110} plane. However, it is possible to use a first monocrystal silicon layer with the main surface of a {110} plane and a second monocrystal silicon layer with the main surface of a {100} plane. That is, (111) faces perpendicular to the substrate have only to be formed by using monocrystal silicon with the main surface of a {110} plane for at least one of the first monocrystal silicon layer 301 and the second monocrystal silicon layer 302. By using the monocrystal silicon layer with the main surface of a {110} plane for the first monocrystal silicon layer, it is possible to form (111) faces perpendicular to the substrate when the liquid channel is formed by etching. This enables the ejection ports to be densely arranged, allowing a reduction in the area of the surface of each ejection port in the print head.

Third Embodiment

In the second embodiment, the first and second monocrystal silicon layers have main surface of a {100} plane and {110}, respectively. However, the present invention is not limited to this combination of monocrystal silicon layers.

In the present embodiment, the first monocrystal silicon layer has a main surface of a {110} plane, and the second monocrystal silicon layer has the main surface of a {110} plane. This allows the liquid channel to be densely arranged.

FIGS. 5A to 5F are cross section views showing a method for manufacturing an ink jet print head in accordance with a third embodiment of the present invention, and the cross section is the same as FIGS. 2A to 2F.

Figure 5A:
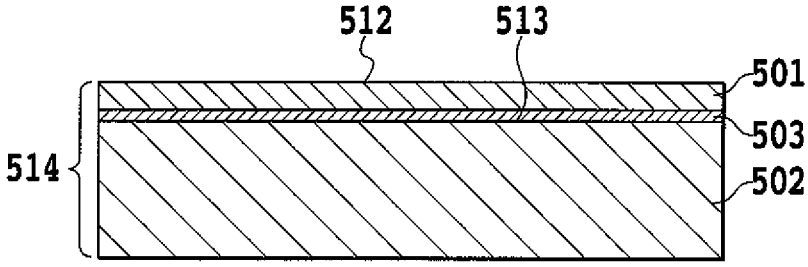
FIGS. 5A to 5F are diagrams showing a process of manufacturing an ink jet print head in accordance with a third embodiment of the present invention.

FIG. 5A is a diagram showing an SOI substrate of diameter 150 mm formed of a first monocrystal silicon layer 501 having a main surface 512 of a {110} plane and a thickness of 25 μm, an insulating layer 503, and a second monocrystal silicon layer 502 also having a main surface 513 of a {110} plane and a thickness of 600 μm.

Figure 5B:
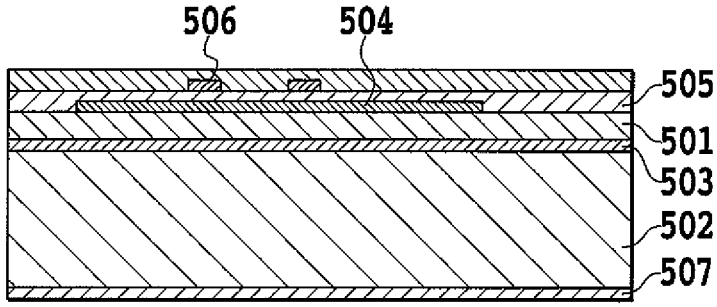

FIG. 5B shows the substrate on which a back surface mask layer 507, a second monocrystal silicon layer 502, an insulating layer 503, a sacrifice layer 504, an etching stop layer 505, heating resistor 506, and a silicon nitride layer have been stacked as in the case of the first embodiment.

Figure 5C:
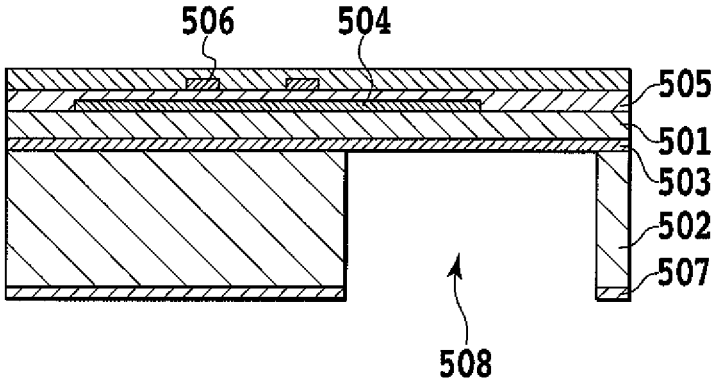
Figure 5D:
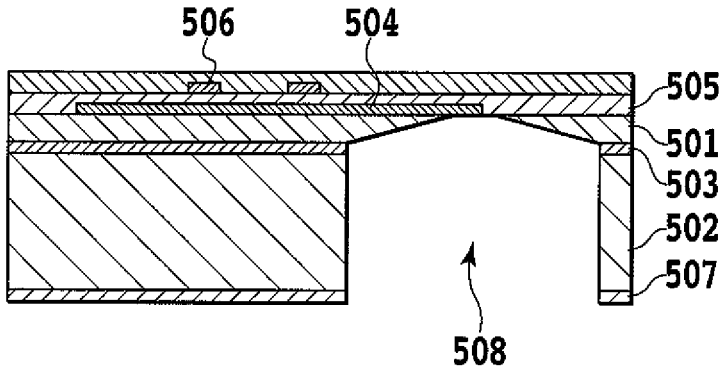

FIG. 5C is a diagram showing the substrate in which a supply port 508 has been formed in the first monocrystal silicon layer 501.

Figure 5E:
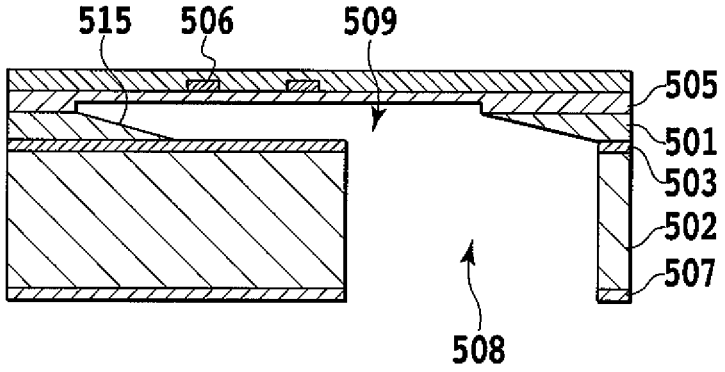
Figure 5F:
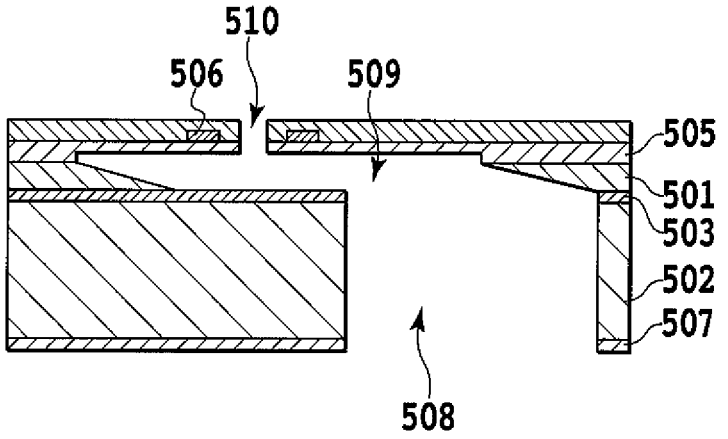

FIGS. 5B to 5F are diagrams showing steps of forming a liquid channel 509. As shown in FIG. 5E, the liquid channel 509 having a side surface 515 inclined at about 15° to the substrate surface is formed by etching.

Figure 6A:
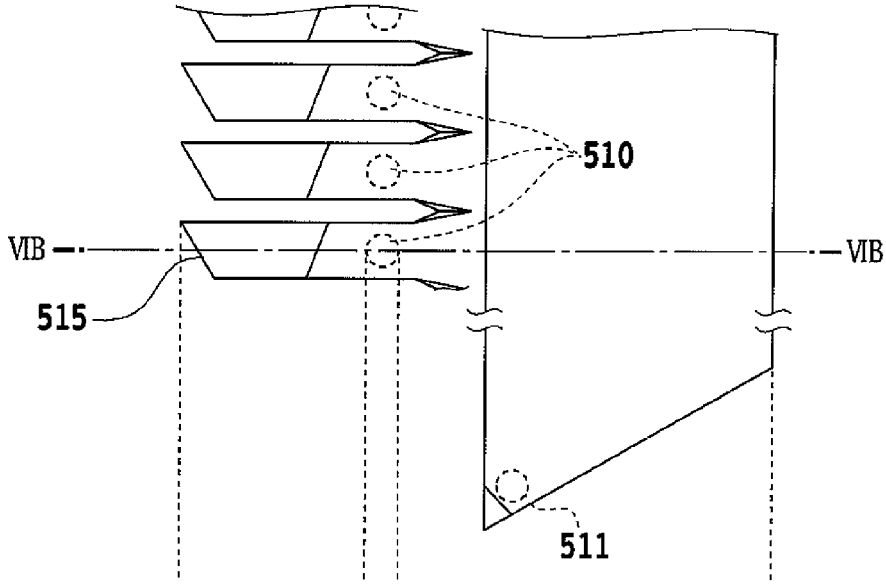
FIGS. 6A and 6B are diagrams showing an ink jet print head in accordance with the third embodiment of the present invention.
Figure 6B:
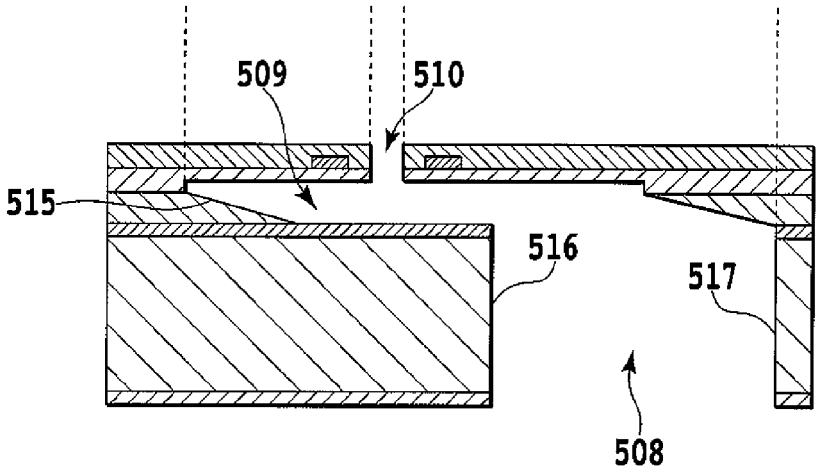

FIGS. 6A and 6B are a top view and a sectional view of the substrate in accordance with the present embodiment described with reference to FIGS. 5A to 5F; FIG. 6B, the sectional view, is taken along dashed line VIB-VIB of FIG. 6A. Reference numeral 511 denotes a position where a guide hole formed in the second monocrystal silicon layer was present.

The liquid channel 509 has at least two parallel side surfaces 515, 518 substantially made of (111) faces. In this case, the crystal direction of each layer is selected so that (111) faces constitute side surface 516. 517 of the supply port 508 and walls between the liquid channel. This enables the production of a print head having a reduced size and densely arranged liquid channels.

Fourth Embodiment

A substrate in accordance with the present embodiment corresponds to the substrate in accordance with the second embodiment in which the guide hole is formed from the first monocrystal silicon layer 301 to the insulating layer 303, in the state of FIG. 3A. The guide hole extending down to the vicinity of the insulating layer is formed, by laser, RIE, ion milling, or the like, in the portion in which the corner of the sacrifice pattern is to be located and a part of the first monocrystal silicon layer which lies immediately above the supply port. In particular, this makes it possible to shape the bottom surface and inner surface of the liquid channel as desired.

The liquid channel, in accordance with the second embodiment, is formed of the (111) faces perpendicular to the substrate surface and the (111) face inclined at about 15° to the substrate surface. In the present embodiment, the guide hole is further formed and used to determine an etching start surface. As a result, the (111) face inclined at about 15° to the substrate surface in accordance with the second embodiment can be made perpendicular to the substrate surface.

Figure 7A:
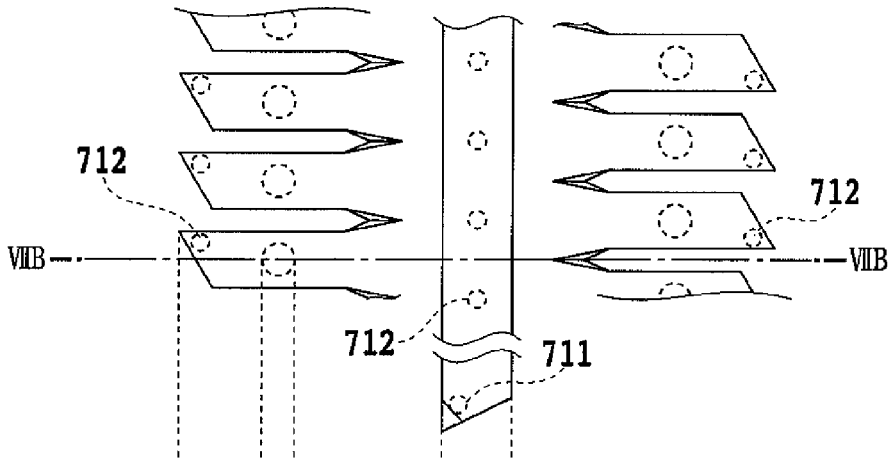
FIGS. 7A and 7B are diagrams showing an ink jet print head in accordance with a fourth embodiment of the present invention.
Figure 7B:
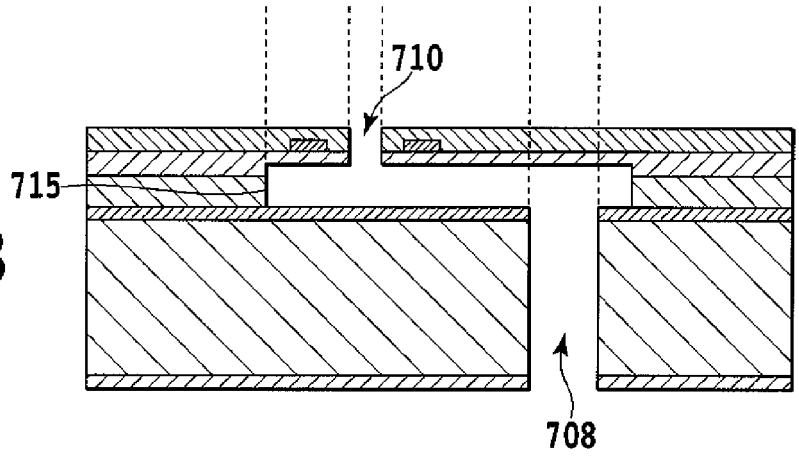
Figure 8A:
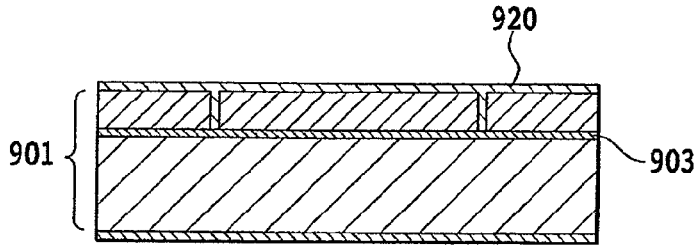
FIG. 8A PRIOR ART
FIGS. 8A to 8C are diagrams showing a conventional method of manufacturing an ink jet print head.
Figure 8B:
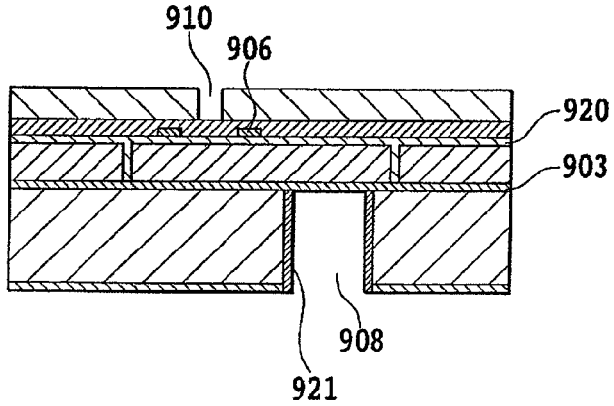
FIG. 8B PRIOR ART
Figure 8C:
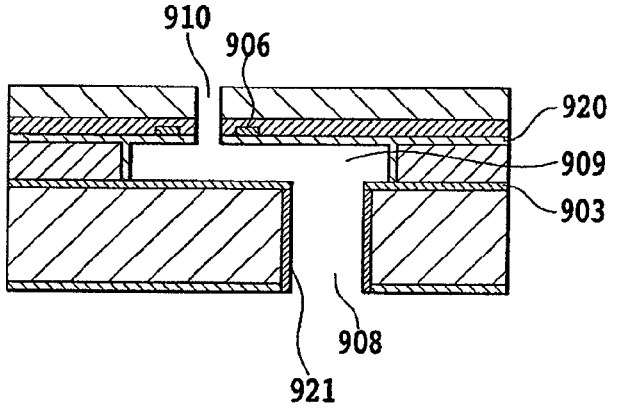
FIG. 8C PRIOR ART

FIGS. 7A and 7B are a top view and a sectional view of the ink jet print head in accordance with the present embodiment; the sectional view is taken along dashed line VIIB-VIIB. Reference numeral 711 denotes a position where the guide hole formed in the second monocrystal silicon layer was present. Reference numeral 712 denotes a position where the guide hole formed in the first monocrystal silicon layer was present. The formation of the guide hole 712 makes it possible to make the wall surface of the liquid channel corresponding to the (111) face inclined at about 15° to the substrate surface, shown in FIG. 6, perpendicular to the substrate surface like a wall surface 715 shown in FIG. 7. This enables a length of the liquid channel to shorten without the volume of the liquid channel being changed. And, this enables a further reduction in the size of the print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-278786, filed Oct. 12, 2006, and No. 2006-278785, filed Oct. 12, 2006, which are hereby incorporated by reference herein in their entirety.

What is claimed is:

1. A method for manufacturing an ink jet print head comprising an ink ejection port, an energy generating element that generates energy utilized to eject ink from the ejection port, an ink channel that is in communication with the ejection port, and an ink supply port that is in communication with the channel to supply ink, the method comprising:

a step of preparing an SOI substrate having a first silicon layer, a second silicon layer, and an insulating layer provided between the first silicon layer and the second silicon layer;

a step of using a material that can be selectively etched in contrast to silicon to form a sacrifice layer on the first silicon layer;

a step of forming an etching stop layer over the sacrifice layer;

a step of forming an energy generating element above a surface of the SOI substrate;

a step of removing a part of the second silicon layer and the insulating layer to form the ink supply port;

a step of performing etching on the first silicon layer to form the channel in which (111) faces of the first silicon layer are exposed; and a step of removing a part of the etching stop layer to form the ejection port.

2. The method for manufacturing the ink jet print head according to claim 1, wherein the insulating layer uses a material that is dissoluble to hydrogen fluoride.

3. The method for manufacturing the ink jet print head according to claim 1, wherein the first silicon layer and the second silicon layer have different crystal directions.

4. The method for manufacturing the ink jet print head according to claim 1, wherein the first silicon layer has a main surface of a {110} plane.

5. The method for manufacturing an ink jet print head according to claim 1, wherein the ink supply port formed in the second silicon layer is formed so that a width of an opening of the ink supply port becomes smaller from a side opposite to a portion where the insulating layer exists to a side of a portion where the insulating layer exists, and the channel is formed in the first silicon layer so that a width of an opening of the channel becomes greater from a side of a portion where the insulating layer exists to a side of a portion where the energy generating element exists.

* * * * *